US005913811A

United States Patent [19]

Kinugawa et al.

[11] Patent Number: 5,913,811

[45] Date of Patent: Jun. 22, 1999

[54] BATTERY-DRIVEN HYDRAULIC EXCAVATOR

[75] Inventors: Hideki Kinugawa; Masayuki Komiyama, both of Hiroshima, Japan

[73] Assignee: Kabushiki Kaisha Kobe Seiko Sho, Kobe, Japan

[21] Appl. No.: 08/970,815

[22] Filed: Nov. 14, 1997

[30] Foreign Application Priority Data

Nov. 22, 1996 [JP] Japan ..... 8-312325

[51] Int. Cl.[6] ..... F16D 31/02

[52] U.S. Cl. ..... 60/420; 60/432

[58] Field of Search ..... 60/420, 431, 432

[56] References Cited

U.S. PATENT DOCUMENTS

| | | | |
|---|---|---|---|
| 4,210,855 | 7/1980 | Harer et al. . | |
| 4,334,408 | 6/1982 | LaPointe | 60/431 X |
| 4,635,440 | 1/1987 | Kropp | 60/431 X |
| 4,723,107 | 2/1988 | Schmid . | |
| 5,479,778 | 1/1996 | Toyooka et al. | 60/431 |
| 5,542,490 | 8/1996 | Kemshall et al. | 60/431 X |
| 5,588,474 | 12/1996 | Egging | 60/431 X |

FOREIGN PATENT DOCUMENTS

| | | |
|---|---|---|
| 4-53846 | 5/1992 | Japan . |
| 8-12298 | 1/1996 | Japan . |

OTHER PUBLICATIONS

U.S. application Ser. No. 08/869,138 filed Jun. 4, 1997.
U.S. application Ser. No. 08/877,554 filed Jun. 17, 1997.
U.S. application Ser. No. 09/082,936 filed May 22, 1998.

Patent Abstracts of Japan, vol. 95, No. 4, May 31, 1995, JP 7–019207, Jan. 20, 1995.

Patent Abstracts of Japan, vol. 18, No. 655 (M–1721), Dec. 12, 1994, JP 6–257186, Sep. 13, 1994.

Patent Abstracts of Japan, vol. 97, No. 10, Oct. 31, 1997, JP 9–158255, Jun. 17, 1997.

Patent Abstracts of Japan, vol. 96, No. 12, Dec. 26, 1996, JP 8–219117, Aug. 27, 1996.

*Primary Examiner*—Hoang Nguyen
*Attorney, Agent, or Firm*—Oblon, Spivak, McClelland, Maier & Neustadt, P.C.

[57] ABSTRACT

The battery-driven hydraulic excavator comprises an electric motor driven by power from the battery, a hydraulic pump driven by the electric motor, and a plurality of hydraulic actuators driven by operating oil from the hydraulic pump. There are provided supply lines for feeding the operating oil in an oil tank from the hydraulic pump into the hydraulic actuators. A differential pressure gauge for detecting the flow rate of operating oil is provided in a main supply line for joining operating oil which were not fed into the hydraulic actuators to return it to the oil tank. Control is made so that power in inverse proportion to the flow rate detected by the differential pressure gauge is supplied to the electric motor. Thereby, the life of the battery can be extended.

6 Claims, 3 Drawing Sheets

BATTERY-DRIVEN HYDRAULIC EXCAVATOR

BACKGROUND OF THE INVENTION

1. Field of the Invention

The present invention relates to a battery-driven hydraulic excavator driven by electric power from a battery mounted 2. Description of the Related Art A battery-driven hydraulic excavator driven by electric power from a battery mounted has been known as disclosed in Japanese Utility Model Laid-Open No. Hei 4-53846 Publication. In this hydraulic excavator, power from the battery drives an electric motor, which in turn drives a hydraulic pump. The hydraulic pump drives a working attachment comprising a boom, an arm and a bucket. The hydraulic pump drives the hydraulic motor so that the hydraulic excavator moves forward or backward.

The battery-driven hydraulic excavator is less in noise and exhaust gas as compared with hydraulic excavators of an internal combustion engine type using as a driving source the internal combustion engine such as a gasoline engine, a Diesel engine. Therefore, the battery-driven hydraulic excavator is suitable for operation in a city area where buildings are thickly settled.

In the conventional battery-driven hydraulic excavators, even if one working attachment stops during operation, other working attachments are often operated. Therefore, the hydraulic pump is continuously driven during a period from the start of operation to the termination of operation. Accordingly, when the hydraulic pump is once driven, even if all the working attachment are stopped for reasons of operation during the operation, the hydraulic pump continues to be driven. Moreover, the discharge amount of the hydraulic pump is normally set constant. Also in the case where only a part of the working attachment is operated and in the case where the operation is discontinued, the hydraulic pump is in operation, thus posing a problem in that power of the battery is consumed wastefully to shorten the life of the battery.

In order to overcome such a problem as noted above, it is contemplated that in the state in which all the operating levers are set to a neutral position, a power switch is turned off. However, in order to achieve this, it is necessary to provide a sensor for detecting a neutral position of the operating levers, thus posing a problem in that the cost increases.

SUMMARY OF THE INVENTION

It is an object of this invention to provide a battery-driven hydraulic excavator which can extend the life of the battery and which is low in cost.

A battery-driven hydraulic excavator according to this invention comprises a battery, an electric motor driven by power from the battery, a hydraulic pump driven by the electric motor, a plurality of actuators driven by operating oil discharged from the hydraulic pump, and operating levers for controlling the operation of the actuators. Operating oil for operating the actuators is fed into the actuators by feed lines. The operating oil not fed into the actuators by the feed lines are joined and returned to an oil tank by return lines. The battery-driven hydraulic excavator according to this invention comprises a flow rate detection means for detecting the flow rate of the operating oil in the return lines, and a control means for supplying to the electric motor the power in inverse proportion to the flow rate detected by the flow rate detection means.

According to this invention, in the state in which the operating amount of the operating levers is small, the supply amount of power to the electric motor is reduced, thus suppressing the consumption of the battery to the minimum.

More preferably, control is made so that when the flow rate obtained when all the operating levers are set to a neutral position is detected by the flow detection means, the power supply from the battery to the electric motor is stopped. In this case, all the operating levers are set to the neutral position in the state in which the electric motor is driven, the surplus operating oil is the maximum flow rate whereby the control means judges that all the working attachments stop their operation to thereby stop the power supply to the electric motor. Therefore, the power consumption in the state in which the working attachments are not in operation is not present to suppress the wasteful power consumption and extend the life of the battery.

More preferably, the flow rate obtained when all the operating levers are set to a neutral position is detected by the flow rate detection means and when the detection state continues for a period of preset time, a power supply from the battery to the electric motor stops. In this case, it is possible to prevent an erroneous control such that a power supply to the electric motor is stopped despite the fact that all the operating levers are not returned to the neutral position due to the unevenness of the flow rate of the surplus operating oil.

Further, it is more preferable if there is provided a switch circuit in which the switch circuit is turned on in the state in which a power supply from the battery to the electric motor is stopped. When in the state in which all the operating levers are returned to the neutral position to cut off the power supply to the electric motor, the switch circuit is turned on whereby the power from the battery is again supplied to the electric motor. It is therefore easy to restart the operation.

DESCRIPTION OF THE PREFERRED EMBODIMENTS

Figure 1:
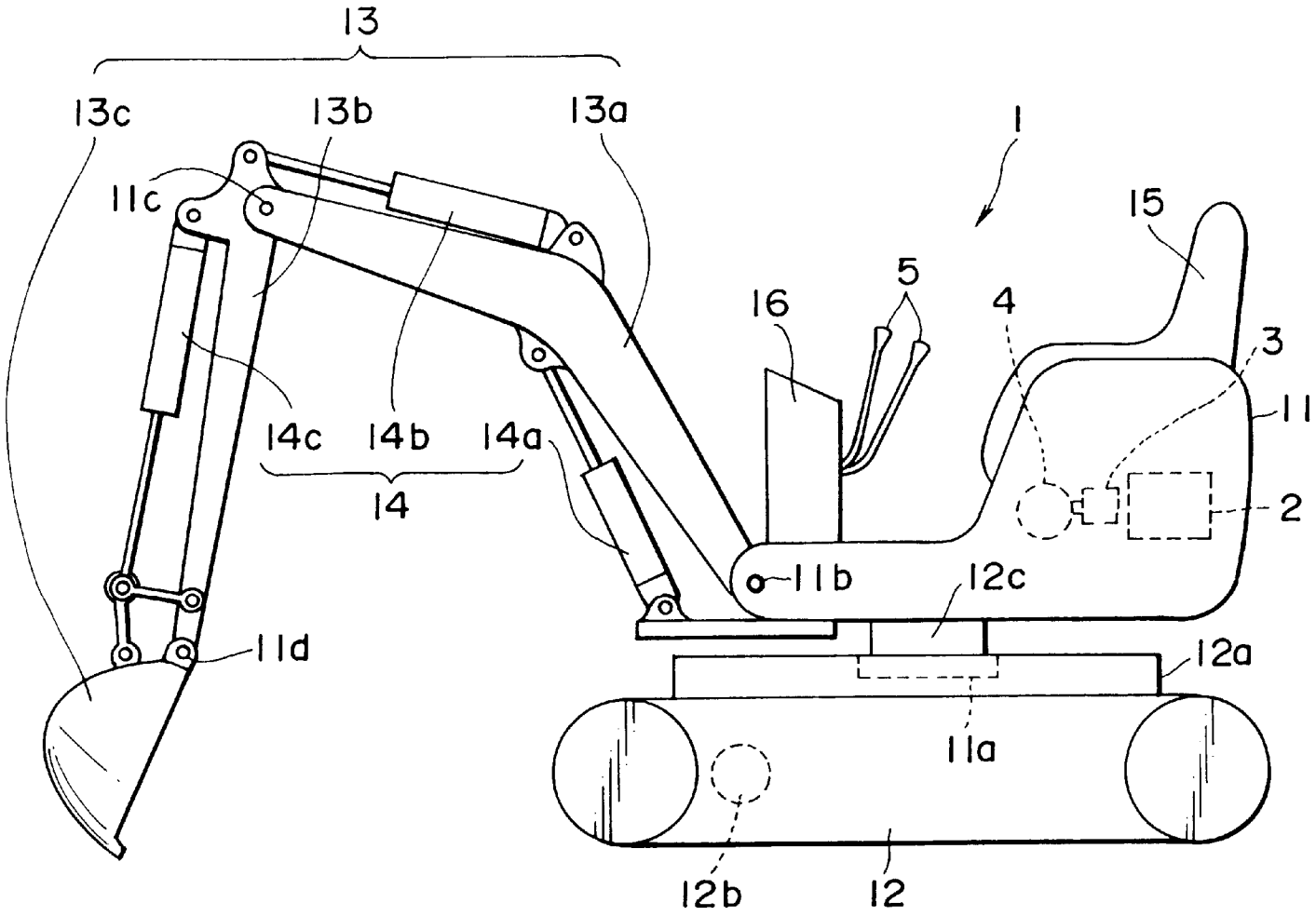
FIG. 1 is a side view showing one embodiment of a hydraulic excavator according to the present invention.

FIG. 1 shows a small-sized hydraulic excavator. A excavator 1 comprises an upper body 11 in which an operator is boarded for operation, a pair of crawlers 12 provided on the bottom of the upper body 11, and an working attachment 13 bendably provided in front of the upper body 11 and operated by the drive of an actuator 14. The crawlers 12 are provided on both sides of a base bed 12*a*. The upper body 11 is supported rotatably around a vertical shaft 12*c* erected in the center of the base bed 12*a*.

The base bed 12*a* is provided with a direction changing actuator 11*a* for rotating the upper body 11 around the vertical shaft 12*c*. The upper body 11 can be changed in horizontal direction with respect to the crawlers 12 by the drive of the actuator 11*a*. The crawlers 12 are driven to be rotated peripherally by a hydraulic motor 12*b* provided on the base bed 12*a*. The excavator 1 can be moved forward, moved backward and changed in course by the crawlers 12.

The working attachment 13 comprises a first arm 13*a* supported rotatably around a horizontal shaft 11*b* provided on the front end of the upper body 11, a second arm 13*b* provided bendably on the extreme end of the first arm 13*a*, and a bucket 13*c* provided bendably on the extreme end of the second arm 13*b*. The actuators 14 comprise a proximal end actuator 14*a* for rotating the first arm 13*a* around the horizontal shaft 11*b*, an intermediate actuator 14*b* for rotating the second arm 13*b* around the horizontal shaft 11*c*, and an extreme end actuator 14*c* for rotating the bucket 13*c* around the horizontal shaft 11*d*.

A battery 2 is mounted interiorly of the upper body 11. An electric motor 3 driven by electric power from the battery 2 and a hydraulic pump 4 driven by the electric motor 3 are arranged interiorly of the upper body 11. Interiorly of the upper body 11 and the base bed 12*a* are provided a circulating pipeline for feeding oil pressure generated by the drive of they hydraulic pump 4 to the actuators 11*a*, 14 and the hydraulic motor 12*b* and a plurality of switching valves for performing the switching of the direction of operating oil of the hydraulic systems and the stopping of operating oil. In the ensuing explanation, all the actuators 11*a*, 14 and the hydraulic motor 12*b* are called "hydraulic actuators".

An operator's seat 15 on which an operator sits to operate the excavator 1 is provided at the rear (rightward in FIG. 1) of the upper body 11. In front of the upper body 11 is erected an operating bed 16 arranged opposite to the operator's seat 15. On the operating bed 16, a plurality of operating means 5 are provided corresponding to the "hydraulic actuators". By operating these operating means 5, supply or stopping a supply of operating oil to the actuators 11*a*, 14 and the hydraulic motor 12*b* is performed through the corresponding switching valves, whereby the actuators 11*a*, 14 and the hydraulic motor 12*b* are driven or stopped.

Figure 2:
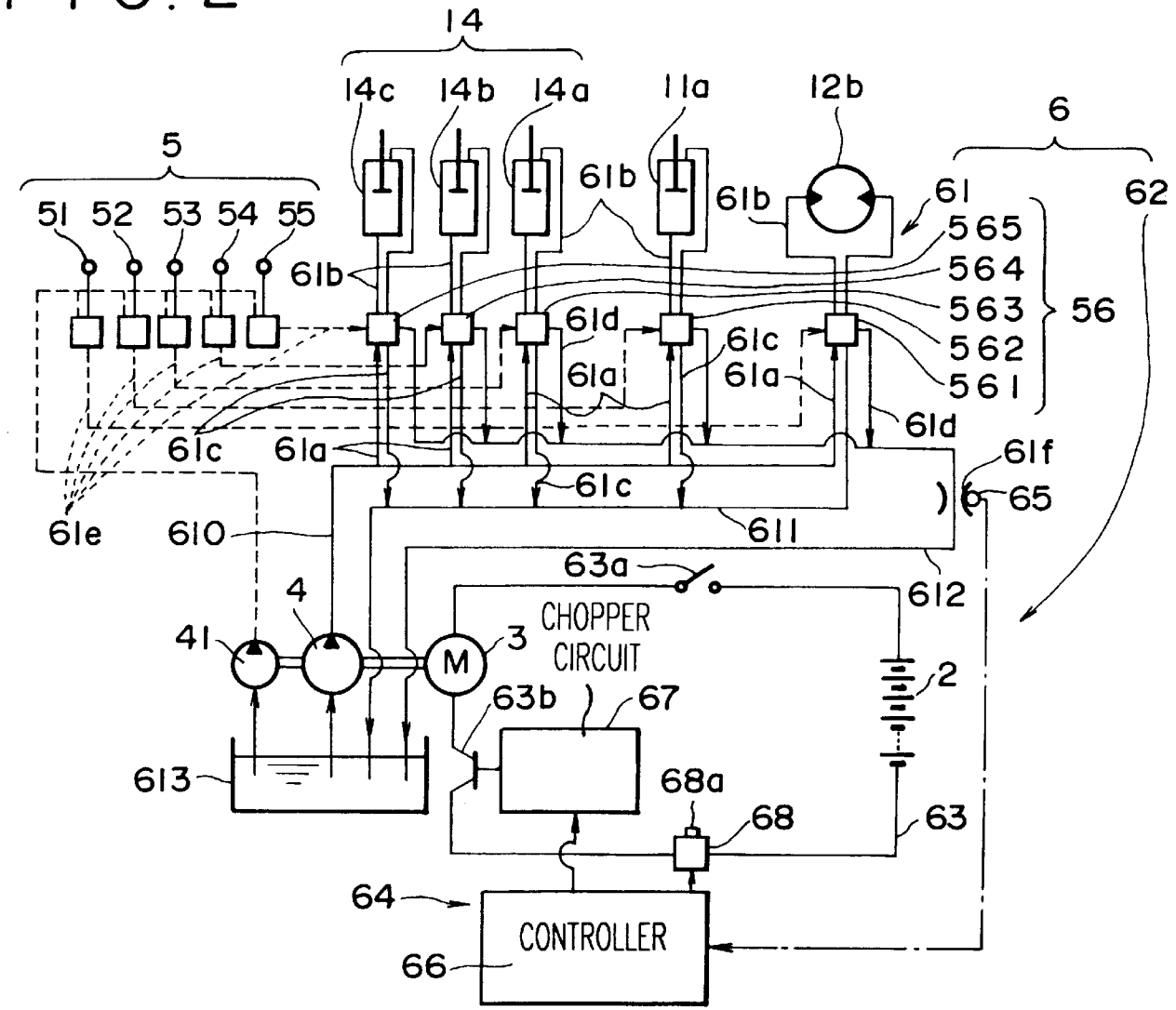
FIG. 2 is a systematic view showing one embodiment of a driving system of a hydraulic excavator according to the present invention.

FIG. 2 is a systematic view showing an embodiment of a drive circuit of a hydraulic excavator according to the present invention. As shown in FIG. 2, a drive system 6 of the excavator 1 comprises a hydraulic system 61 and an electric system 62. The hydraulic system 61 comprises the hydraulic pump 4, a pilot pump 41 coaxial with and cooperated with the hydraulic pump 4, the operating means 5, a direction switching valves 56, and "hydraulic actuators". The hydraulic pump 4 operates the "hydraulic actuators" by operating oil pumped up from an oil tank 613. The pilot pump 41 operates the direction switching valves 56 by pilot oil pumped up from the oil tank 613.

The operating means 5 comprises a first operating lever 51 corresponding to the hydraulic motor 12*b*, a second operating lever 52 corresponding to the direction changing actuator 11*a*, a third operating lever 53 corresponding to the proximal end actuator 14*a*, a fourth operating lever 54 corresponding to the intermediate actuator 14*b*, and a fifth operating lever 55 corresponding to the extreme end actuator 14*c*. The direction switching valves 56 comprise a first switching valve 561 corresponding to the first operating lever 51, a second switching valve 562 corresponding to the second operating lever 52, a third switching valve 563 corresponding to the third operating lever 53, a fourth switching valve 564 corresponding to the fourth operating lever 54, and a switching valve 565 corresponding to the fifth operating lever 55.

Between the hydraulic pump 4 and the direction switching valves 56 are provided a main supply line 610 and five supply lines 61*a* branched from the main supply line 610 and connected to the first to fifth switching valves 561 to 565, respectively. Between the switching valves 561 to 565 and the "hydraulic motors" is provided oil lines 61*b*.

The operating oil discharged from the hydraulic pump 4 flows through the first hydraulic line 61*a* and the oil lines 61*b* in the open state of the switching valve (one of the switching valves 561 to 565). Thereby, any of the hydraulic motor 12*b*, the actuator 11*a*, the proximal end actuator 14*a*, the intermediate actuator 14*b* and the extreme end actuator 14*c* corresponding to the opened switching valve (any of the switching valves 561 to 565) is operated in a predetermined direction, and the "hydraulic actuator" corresponding to the closed switching valve stops.

The switching valves 561 to 565 are provided with a plurality of return lines 61*c* for returning the operating oil by which the "hydraulic actuators" are operated to an oil tank 613 through a main return line 611. Further, there are provided a plurality of drain lines 61*d* for returning the operating oil, which was not used to operate the "hydraulic actuators", to the oil tank 613 through a main drain line 612.

The drain lines 61*d* are provided with orifices 61*f*. By measuring a pressure difference between the before and behind of the orifice 61*f*, the flow rate of the operating oil returned to the oil tank 613 through the main drain line 612 is detected.

A pilot line 61*e* is provided between the pilot pump 41 and the operating levers 51 to 55. The pilot oil discharged from the pilot pump 41 is supplied to the switching valve (any of the switching valves 561 to 565) corresponding to the operating lever operated through the pilot line 61*e*. The switching valve corresponding to the operating lever operated is operated by a supply of the pilot oil to operate any of the "hydraulic actuators". The operation of the "hydraulic actuators" is stopped by returning the operating lever to a neutral position.

The electric system 62 comprises a loop circuit 63 to which the battery 2 and the electric motor 3 are connected in series, and a control circuit 64 for controlling a DC pulse of the loop circuit 63. The control circuit 64 is provided with a differential pressure gauge 65 for detecting a pressure difference between the before and behind of the orifice 6 if of the operating oil (surplus operating oil) returned to the hydraulic system 61, a control means 66 for controlling the number of revolutions of the electric motor 3 on the basis of the detected result of the differential pressure gauge 65, a chopper circuit 67 and a switch circuit 68 operated by a control signal from the control means 66.

Figure 3:
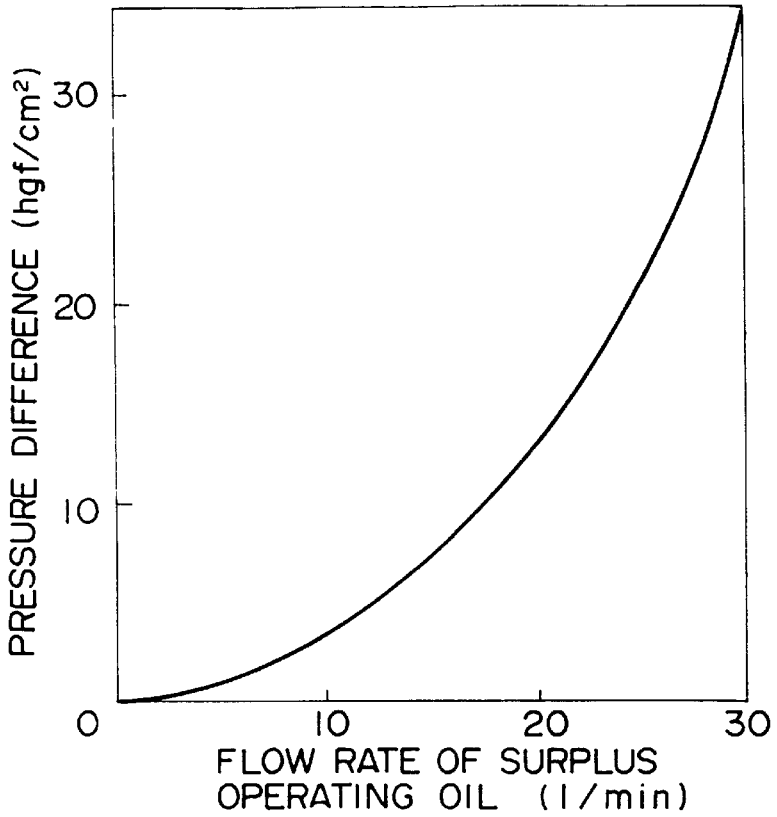
FIG. 3 is a graph showing a relationship between a pressure difference and a flow rate of a surplus operating oil.

The differential pressure gauge 65 measures a pressure difference between upstream and downstream of the orifice 61*f*. A predetermined signal is output from the control means 66 to the chopper circuit 67 on the basis of the result of measurement. FIG. 3 is a graph showing a relationship between a pressure difference between upstream and downstream of the orifice 61*f* and the flow rate of the surplus operating oil. As will be understood from the graph, the flow rate of the surplus operating oil increases as the pressure difference increases. Accordingly, the flow rate (much or less) of the surplus operating oil can be discriminated by detecting the pressure difference. When the surplus operation oil is less, the amount of the operating oil which is fed to the hydraulic motor 12*b* or the like for work is much, whereas when the surplus operating oil is much, the amount of the operating oil which was worked in the hydraulic motor 12*b* is less.

The loop circuit 63 is provided with a key switch 63*a*. The loop circuit 63 is further provided with a transistor 63*b*. A base terminal of the transistor 63*b* is connected to the chopper circuit 67. The key switch 63*a* is turned on before the operation is started by the excavator 1. When the key switch 63*a* is turned on, the excavator 1 is placed in the operatable condition. The key switch 63*a* keeps the on-state during operation, and is turned off upon termination of operation.

The chopper circuit 67 continuously outputs a DC current input for a fixed period. In the present embodiment, the chopper circuit 67 outputs a pulse having a predetermined pulse width on the basis of a control signal from the control means 66. Electric power corresponding to the pulse width is supplied to the electric motor 3 so that the number of revolutions of the electric motor 3 is proportional to the pulse width.

The switch circuit 68 opens and closes the loop circuit 63 according to the control signal from the control means 66. The switch circuit 68 is provided with a push-on type start switch 68*a* which is turned on and off during operation by an operator. The start switch 68*a* opens and closes the loop circuit 63 by the control signal from the control means 66 even when the switch circuit 68 is turned off. The control means 66 outputs a control signal to the chopper circuit 67 on the basis of the detection signal from the differential pressure gauge 65 and drives the electric motor 3 with the number of revolutions in inverse proportion to the pressure difference before and behind the orifice 61*f*. More specifically, the control means 66 outputs a control signal to the chopper circuit 67 so that the pulse width of the pulse signal output from the chopper circuit 67 to the transistor 63*b* is in inverse proportion to the pressure difference before and after the orifice 61*f*.

Figure 4:
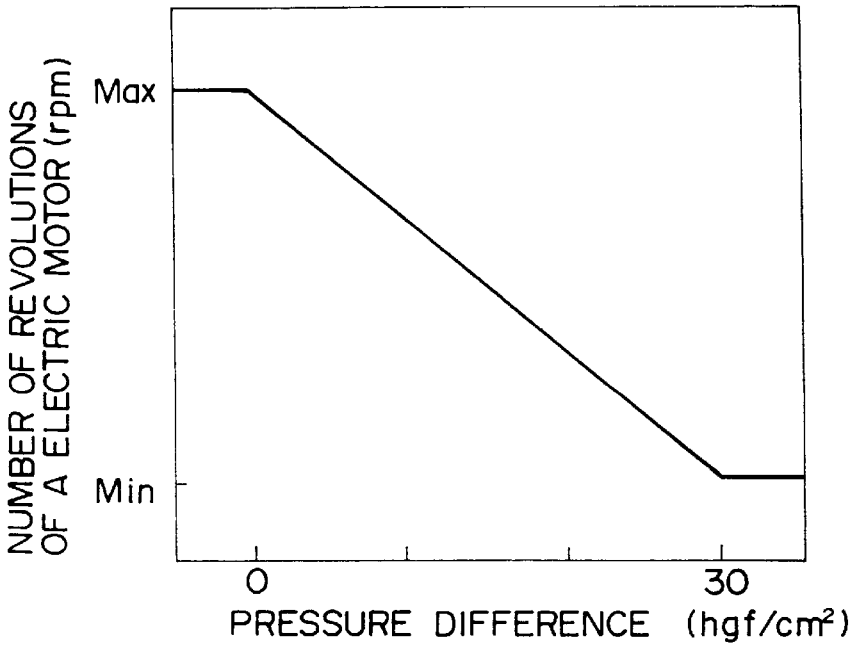
FIG. 4 is a graph showing a relationship between a pressure difference and the number of revolutions of an electric motor.

FIG. 4 shows a relationship between the pressure difference and the number of revolutions of the electric motor 3. As shown in FIG. 4, when the pressure difference is large (the flow rate of the surplus operating oil is large), that is, when the amount of the operating oil discharged from the hydraulic pump 4 used to operate the "hydraulic actuators" is less, the number of revolutions of the electric motor 3 reduces. Conversely, when the pressure difference is large (the flow rate of the surplus operating oil is large), that is, when the amount of the operating oil discharged from the hydraulic pump 4 used to operate the "hydraulic actuators" is much, the number of revolutions of the electric motor 3 increases.

When the start switch 68*a* is turned on to operate the operating means 5 whereby the "hydraulic actuators" are operated to perform the predetermined operation after which all the operating levers 51 to 55 are returned to the neutral position for certain reasons, the operating oil is not delivered from all the switching valves 561 to 565 to the oil lines 61*b*. Therefore, all the operating oil discharged from the hydraulic pump 4 are returned as the surplus operating oil to the oil tank 613 through the main drain line 612. In the present embodiment, this is detected by the differential pressure gauge 65 to input the detection signal to the control means 66 so that a switch-off control signal is output from the control means 66 to the switch circuit 68 to cut off a supply of current to the electric motor 3. When all the operating levers 51 to 55 are returned halfway of the operation, the driving of the hydraulic pump 4 is discontinued by a stop of supplying power to the electric motor 3 so as to prevent a wasteful power consumption of the battery 2.

In the start of operation, first, the key switch 63*a* (FIG. 2) is turned on. Thereby, the control means 66 starts controlling. First, a control signal is output to the chopper circuit 67 so that the electric motor 3 is driven at the minimum number of revolutions. However, in this state, the switch circuit 68 is in the off state, and power from the battery 2 is not supplied to the electric motor 3. Accordingly, when the operation starts actually, the start switch 68*a* is turned on to energize the loop circuit 63. The electric motor 3 is rotated with the minimum number of revolutions by the pulse signal from the chopper circuit 67 whose duty ratio is set to the minimum valve in the present control. Thereafter, the operating means 5 is operated whereby the excavator 1 is operated on the basis of the control of the control means 66.

When the electric motor 3 is driven at the minimum number of revolutions and the operating means 5 is not operated, the hydraulic pump 4 is also driven at the minimum number of revolutions and the discharge amount of the operating oil caused thereby is minimum. However, since the operating mean 5 is not operated, the operating oil supplied to the switching valves 561 to 565 is not supply to any of the actuator 14, the direction changing actuator 11*a* and the hydraulic motor 12*b* and is returned to all the oil tanks 613. For this reason, the flow rate of the operating oil passing through the orifice 61*f* is the maximum flow rate (reference flow rate) despite the fact that the hydraulic pump 4 is driven at the minimum discharge amount. Accordingly, in the state in which all the operating levers 51 to 55 are set to the neutral position, the flow rate of the surplus operating oil is maximum as shown in FIG. 4. The control signal is output from the control means 66 to the chopper circuit 67 by the detection signal from the differential pressure gauge 65 having detected the flow rate of the surplus operating oil. The transistor 63*b* is turned on and off by the pulse signal of the minimum duty ratio from the chopper circuit 67 so that the electric motor 3 continues driving at the minimum number of revolutions.

Then, when the first operating lever 51 is operated, the operating oil discharged from the hydraulic pump 4 passes through the opened first switching valve 561 and is supplied to the hydraulic motor 12*b*. For this reason, the amount of the surplus operating oil returned to the main drain line 612 from the direction switching valve 56 is smaller than the reference flow rate by the amount supplied to the hydraulic motor 12*b*. The flow rate of the reduced surplus operating oil is detected by the differential pressure gauge 65, and the detection signal is input into the control means 66. The control means 66 outputs to the chopper circuit 67 the control signal whose duty ratio increases in proportion to the reduced flow rate. A supply of power to the electric motor 3 increases according to an increase in control signal of the control means 66. Thereby, the number of revolutions of the electric motor 3 and the discharge amount of the hydraulic pump 4 increase.

Then, when the second operating lever 52 is operated to the operating position in the state in which the hydraulic motor 12*b* is operated (that is, in the state in which the first operating lever 51 is set to the operating position), the operating oil from the hydraulic pump 4 operates the direction changing actuator 11*a* in addition to the hydraulic motor 12*b*. For this reason, the surplus operating oil further reduces, and the discharge amount of the hydraulic pump 4 further increases. Accordingly, the discharge amount suitable to both the hydraulic motor 12*b* and the direction changing actuator 11*a* results.

In this manner, since the discharge amount of the operating oil of the hydraulic pump 4 increases or decreases according to the number of operations of the hydraulic motor 12*b* or the like, all the "hydraulic actuators" corresponding to the operating levers 51 to 55 operated are normally operated. In addition, since the hydraulic pump 4 always discharges a necessary and sufficient amount of operating oil, a wasteful power consumption can be positively suppressed to prolong the life of the battery 2.

Then, when all the operating levers 51 to 55 are returned to the neutral position, the operating oil is not delivered from the switching valves 561 to 565 to the oil lines 61*b*, and all the operating oil discharged from the hydraulic pump 4 passes, as the surplus operating oil, through the main drain line 612, and is returned to the oil tank 613. This is detected by the differential pressure gauge 65, and the detection signal is input into the control means 66. The control means 66 outputs the switch-off control signal to the switch circuit 68 on the basis of the detection signal so that a current does not flow into the loop circuit 63 to stop a supply of power to the electric motor 3. The electric motor 3 is stopped by a stop supplying power to prevent a wasteful power consumption of the battery 2. When the operating means 5 is re-operated, the start switch 68*a* is pushed on prior thereto.

As described in detail above, in the present embodiment, the flow rate of the operating oil supplied to the "hydraulic actuators", that is, the discharge amount of the operating oil of the hydraulic pump 4 is detected by the flow rate of the surplus operating oil which was not supplied to the "hydraulic actuators". The number of revolutions of the electric motor 3 is controlled so that the discharge amount of the operating oil according to the number of operation of the "hydraulic actuators" is obtained. All the operating levers 51 to 55 are returned to the neutral position whereby the operation of all the "hydraulic actuators" is stopped to thereby stop a power supply to the electric motor 3. Therefore, even in the case where all the working attachments discontinue the operation during a period of operation, it is possible to positively prevent an occurrence of a wasteful power consumption by which the hydraulic pump 4 is driven by the electric motor 3 to keep circulation of the operating oil. Accordingly, it is possible to prolong the life of the battery 2, and it is very effective in increasing the operating amount in a period of one charging.

The present invention is not limited to the above-described embodiments but includes the following contents.

(1) While in the above-described embodiments, the loop circuit 63 is provided with the switch circuit 68, the switch circuit 68 is not necessary for the present invention. In the case where the switch circuit 68 is not provided, in the state in which all the operating levers 51 to 55 are returned to the neutral position, the operating oil discharged from the hydraulic pump 4 is not used to operate the "hydraulic actuators" but all of them are surplus operating oil, which are returned to the oil tank 613. Therefore, the maximum flow rate of the surplus operating oil is detected by the differential pressure gauge 65, and the number of revolutions of the electric motor 3 is minimized by the control means 66. Accordingly, the power consumption of the battery 2 can be reduced.

Further, since the hydraulic pump 4 is always driven, when any of the operating levers 51 to 55 is operated to re-start the operation, the operation can be re-started by operating the operating levers 51 to 55 without turning on the start switch 68*a*. Thereby, the workability can be enhanced.

(2) In the above-described embodiments, when the flow rate of the surplus operating oil exceeds a preset value, the switch-off control signal is output from the control means 66 to the switch circuit 68. Instead, a timer is provided internally of the control means 66 to measure the time at which the flow rate of the surplus operating oil exceeds the preset value. When the time measured value exceeds a predetermined time, the switch circuit 68 may be caused to switch-off. By doing so, an erroneous control such that a power supply to the electric motor 3 is stopped despite the fact that all the operating levers 51 to 55 are not returned to the neutral position due to the unevenness of the flow rate of the surplus operating oil.

(3) In the above-described embodiments, a supply amount of the operating oil to the hydraulic motor 12*b* or the like in the state in which the operating levers 51 to 55 are set to the operating position is set constant. However, an opening degree of the switching valves 561 to 565 may be changed according to the operating amount at the operating position of the operating levers 51 to 55. Thereby, the operating speed of the "hydraulic actuators" is changed according to the operating amount of the operating levers 51 to 55.

(4) In the above-described embodiments, the flow rate of the surplus operating oil is detected on the basis of the detection value of the differential pressure gauge 65 for measuring a pressure difference between the before and behind the orifice 61*f*. A flowmeter for directly measuring the flow rate of surplus operating oil may be employed in place of the differential pressure meter 65.

We claim:

1. A battery-driven hydraulic excavator comprising:

a battery;

an electric motor driven by power from the battery;

a hydraulic pump driven by the electric motor;

a plurality of actuators driven by operating oil discharged from the hydraulic pump;

operating levers for controlling the operation of the actuators;

a feed line for feeding operating oil into the actuators by the driving of said hydraulic pump;

a return line for joining operating oil which were not fed into the actuators by said feed line to return the operating oil to an oil tank;

a flow rate detector positioned to detect the flow rate of the operating oil in said return line; and a control means for supplying power to the electric motor in inverse proportion to the flow rate detected by said flow rate detector.

2. The battery-driven hydraulic excavator according to claim 1, wherein said control means controls so as to stop a power supply from the battery to the electric motor when the flow rate obtained in a condition that all the operating levers are set to a neutral position is detected by said flow rate detector means.

3. The battery-driven hydraulic excavator according to claim 1, wherein said control means stops a power supply from the battery to the electric motor, when the flow rate obtained in a condition that all the operating levers are set to a neutral position is detected by said flow rate detector means and continues for a preset period of time.

4. The battery-driven hydraulic excavator according to claim 1, wherein said control means involves a switch circuit in which said switch circuit is turned on to start the power supply from the battery to the electric motor in a condition that a power supply from the battery to the electric motor is stopped.

5. The battery-driven hydraulic excavator according to claim 1, wherein said flow rate detector means comprise an orifice provided in the return line, and a differential pressure gauge for detecting a pressure difference before and behind the orifice.

6. The battery-driven hydraulic excavator according to claim 1, wherein said actuator comprises a hydraulic motor for driving crawlers, a direction changing actuator for rotating an upper body, and actuators for moving a working attachment.

* * * * *